United States Patent [19]

Keller

[11] 3,973,683

[45] Aug. 10, 1976

[54] SAFETY MEANS FOR FIBER PICK-UP AND TRANSPORTING APPARATUS

[75] Inventor: Alex Jacques Keller, Gastonia, N.C.

[73] Assignee: Automatic Material Handling, Inc., Gastonia, N.C.

[22] Filed: Apr. 17, 1975

[21] Appl. No.: 568,853

[52] U.S. Cl. ..... 214/1 BB; 212/20; 212/21; 214/88; 214/658

[51] Int. Cl.[2] ..... B66C 17/00

[58] Field of Search ..... 214/1 BB, 658, 1 BT, 214/87, 88; 212/10, 20, 13, 21, 18, 39 R, 124, 125, 127, 132

[56] References Cited

UNITED STATES PATENTS 3,166,023 1/1965 Lynd ..... 212/124 X

R20,630 1/1938 Hallenbeck ..... 212/132

*Primary Examiner*—Robert J. Spar
*Assistant Examiner*—George F. Abraham
*Attorney, Agent, or Firm*—Richards, Shefte & Pinckney

[57] ABSTRACT

A plurality of safety devices associated with apparatus for picking-up fibers from bales and delivering such fibers to a hopper or the like, such safety device acting to warn the operator of such apparatus of a variety of malfunctions of the apparatus when they occur, and to activate controls for preventing damage to such apparatus or injury to personnel upon the occurrence of such malfunctions.

11 Claims, 9 Drawing Figures

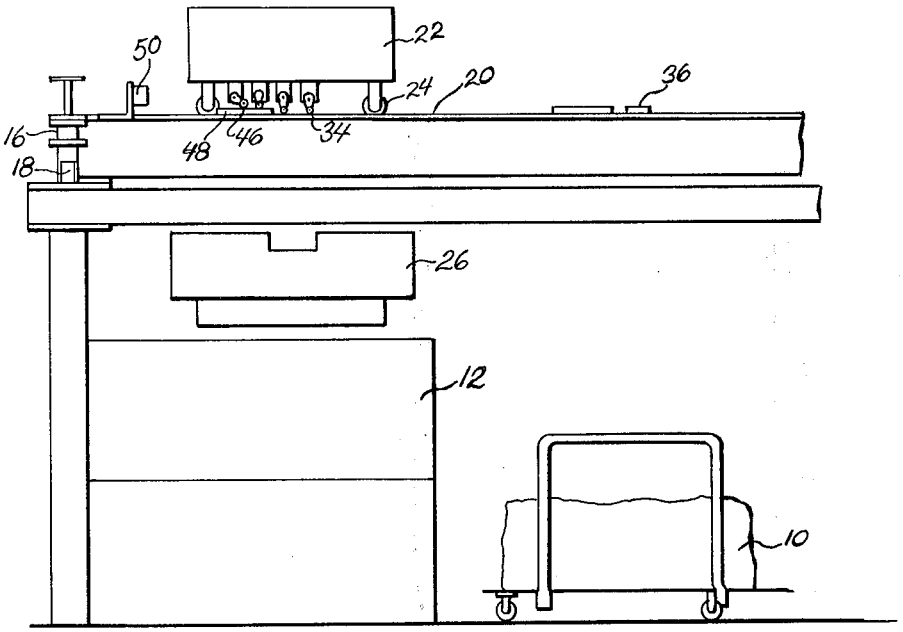
Fig. 6
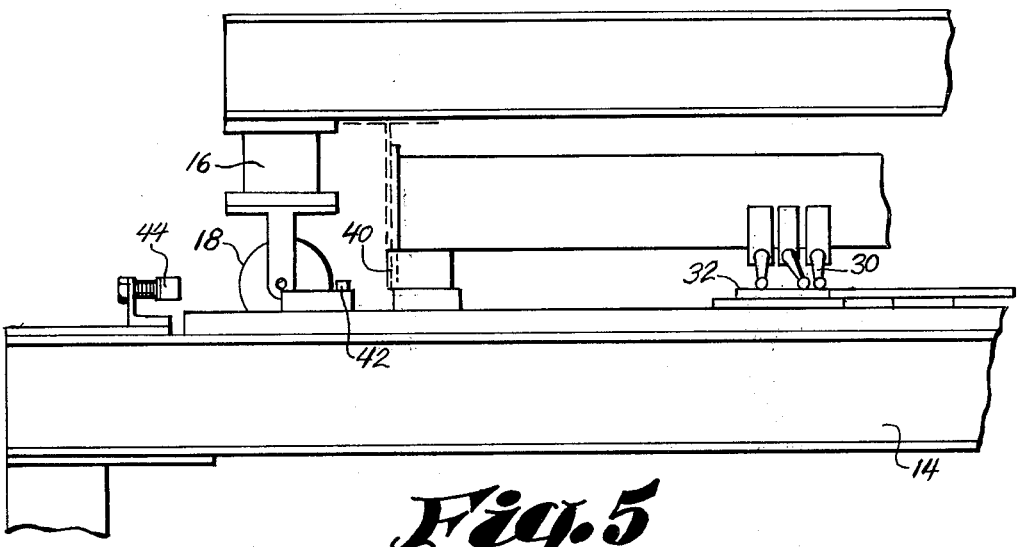
Fig. 5
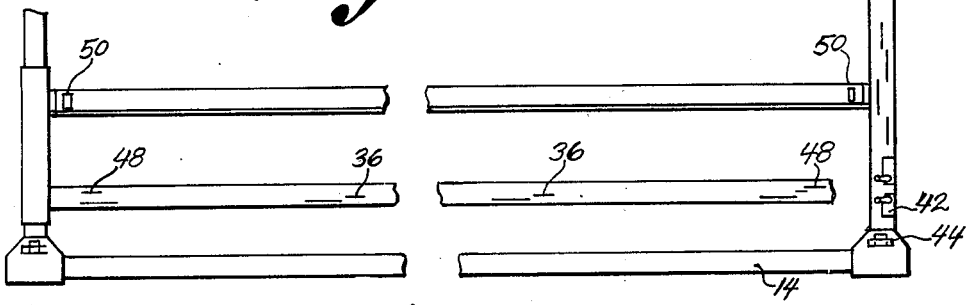
Fig. 4
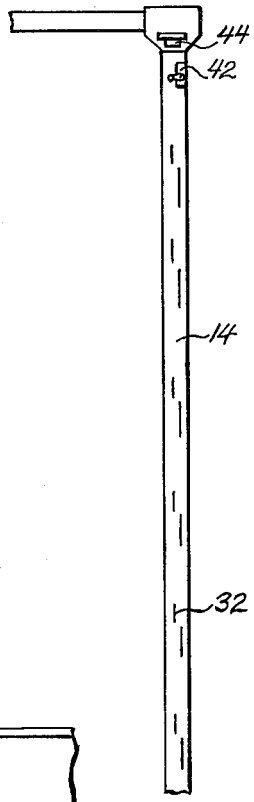

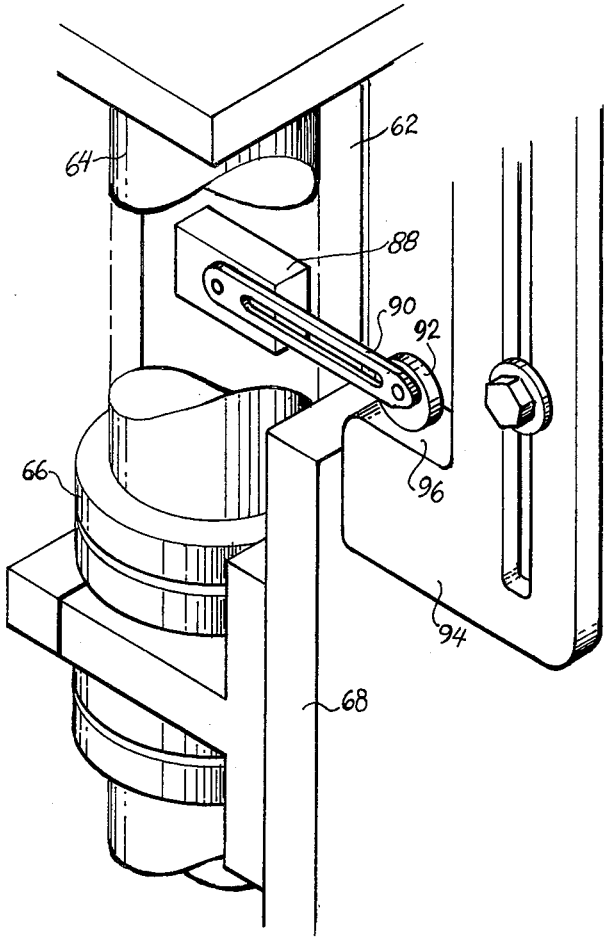
Fig. 9
Fig. 8
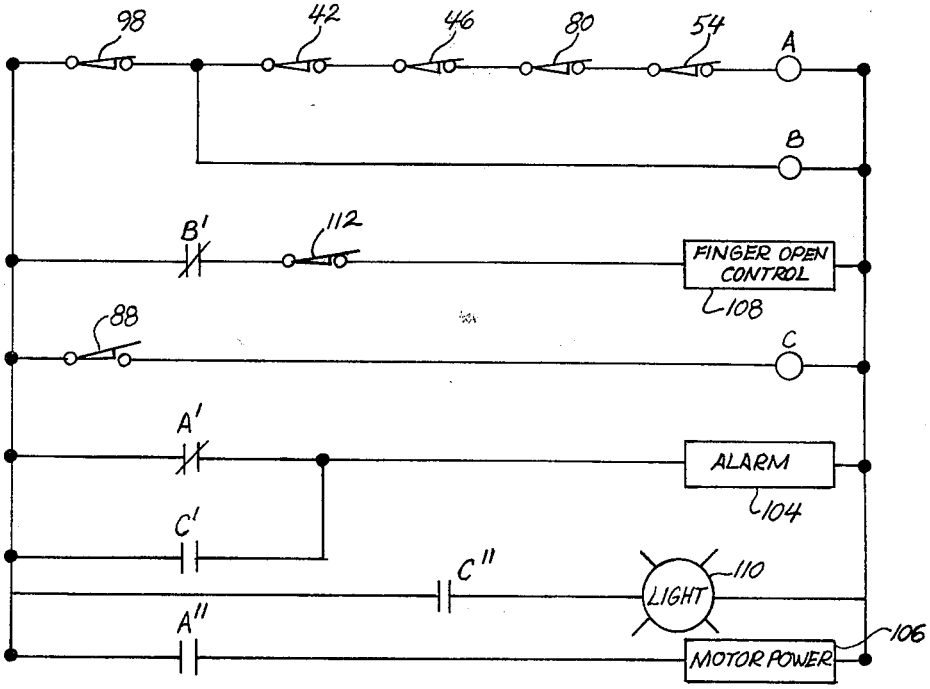

SAFETY MEANS FOR FIBER PICK-UP AND TRANSPORTING APPARATUS

BACKGROUND OF THE INVENTION

In an effort to avoid the disadvantages inherent in manually opening bales of fiber, such as cotton, and delivering fiber plucked from such bales to hoppers or the like for subsequent processing (e.g. blending), apparatus has been developed for mechanically carrying out these functions, an example of such mechanical apparatus being disclosed in U.S. Pat. No. 3,777,908, issued to Keller.

Such apparatus generally includes an elevated trackway located at the periphery of a bale laydown including a plurality of bales arranged in a desired pattern behind a plurality of hoppers or conveyor belt stations. As explained in greater detail in the aforementioned U.S. Pat. No. 3,777,908, a crane or frame is mounted on the elevated trackway for movement therealong above the bale laydown and this crane includes tracks extending along the length thereof for supporting a carriage or dolly that is arranged to move selectively along the crane tracks. A pick-up head is mounted on the dolly for selective vertical movement with respect thereto, and this pick-up head includes cooperating finger elements or tongs which can be selectively opened and closed to pick up a predetermined quantity of fibers from bales in the laydown.

In a commercial embodiment of the aforementioned apparatus, an automatic control system is provided for selectively moving the crane and dolly to any of a plurality of locations directly above the designated bale positions in the bale laydown, and the pick-up head is then lowered until a bale at any such designated position is engaged by a sensor asociated with the pick-up head, whereupon the finger elements close to remove a quantity of fiber from the bale and the pick-up head is raised and carried to a hopper or conveyor by the coordinated movement of the crane and dolly. This control system includes a plurality of cams fixed on the trackway and on the crane tracks at predetermined locations, and the crane and dolly are provided with switches arranged to be tripped by particular cams. An electronic control circuit is provided to automatically direct and coordinate movement of the crane along the trackway and the dolly along the crane tracks until the switches thereon are tripped by designated track and trackway cams, whereupon the crane and dolly will stop and thereby locate the pick-up head directly above a designated bale from which it is desired to remove fibers. The control system then causes the pick-up head to be lowered until the sensor engages the designated bale as aforesaid, after which the control system causes the crane and dolly to carry the pick-up head to a hopper or conveyor location at which the fibers are released by the pick-up head. It will be appreciated that the trackway cams and the crane track cams are located so as to permit the control system to move the crane, dolly and pick-up head to a position above any particular bale in the bale laydown, and the control system may be programmed to have the pick-up head remove fibers from any such bale in the bale laydown for delivery to any hopper or conveyor associated with such bale laydown.

While the normal operation of the aforementioned apparatus has been found to be quite satisfactory, it has been determined that on rare occasions malfunctions occur in the operation of the apparatus which can create dangerous situations, both in terms of damage to the apparatus itself and in terms of injury to any personnel who may be working in the vicinity of the apparatus. When it is recognized that the aforementioned apparatus is very large and expensive to produce, it will be appreciated that any damage or injury which is caused by a malfunction of the equipment is likely to be severe. For example, if the crane should become derailed, the apparatus could actually fall from the elevated trackway and cause significant damage to the apparatus as well as create a substantial hazard to anyone in the adjacent work area.

The present invention provides a safety system for apparatus of the aforementioned type which is designed to provide a recognizable indication that any one of a number of possible malfunctions has occurred, and to either stop further operation of the apparatus or provide corrective control measures therefor which will prevent damage to the apparatus or injury to personnel.

SUMMARY OF THE INVENTION

In accordance with the present invention, a plurality of switches are incorporated in apparatus of the general type described above, and each such switch is arranged to be actuated upon the occurence of a particular malfunction of the apparatus. These switches may be included in an electrical alarm circuit which will provide a signal (e.g. the ringing of a bell) when any one of such switches is actuated, and these switches are additionally included in the control systems for the crane, dolly or pick-up head whereby the actuation of a particular safety switch will result in a predetermined control influence being imposed on the apparatus to prevent or at least alleviate any damage which the apparatus might otherwise cause.

The safety switches included in the present invention are as follows:

a. a first switch connected to a pull cord on the pick-up head which, when actuation, energized the alarm, stops further operation of the apparatus, and causes the cooperating finger elements on the pick-up head to open if they are closed when this first switch is actuated;

b. a second switch associated with an extendable line (e.g. a link chain) used to raise and lower the pick-up head, this second switch being actuated in response to the entire length of the extendable line being fed out in lowering the pick-up head to thereby energize the alarm and stop further operation of the apparatus;

c. a third switch associated with the pick-up head and actuated by the pick-up head moving a predetermined distance beneath the dolly to thereby energize the alarm, close the cooperating finger elements, and cause the pick-up head to move upwardly in its normal operating sequence;

d. a fourth switch associated with the dolly and actuated in response to the dolly moving past a predetermined point on the crane tracks to thereby stop further operation of the machine and energize the alarm;

e. a fifth switch associated with the crane and actuated in response to the crane moving past a predetermined point on the trackway to thereby energize the alarm and stop further operation of the apparatus;

f. a sixth switch associated with the crane and actuated in response to the crane means assuming a predetermined canted relationship with respect to the trackway to thereby energize the alarm and stop further operation of the apparatus; and g. a seventh switch associated with the pick-up head and actuated by a predetermined slack forming in the extendable line used to raise and lower the pick-up head to thereby cause the cooperating finger element to close and cause the pick-up head to move upwardly in its normal operating sequence.

Preferably, the aforementioned first switch is connected to a pull-cord strung around the periphery of the pick-up head whereby such pull-cord can be readily reached by anyone near the pick-up head for manually actuating the first switch.

Also, the aforementioned seventh switch preferably includes a switch actuating lever biased against the extendable line to maintain the switch in a non-actuated condition as long as the extendable line is taut. When, however, a predetermined amount of slack forms in the extendable line, the bias will urge the actuating lever to a position for actuating the switch.

BRIEF DESCRIPTION OF THE DRAWINGS

FIG. 4 is a plan view of the trackway and crane tracks illustrating the operating switch cams located thereon;

FIG. 5 is a front elevational view of a part of the trackway, crane and dolly;

FIG. 6 is a side elevational view of a part of the trackway, tracks, crane and dolly;

FIG. 8 is a wiring diagram illustrating the alarm circuit and motor stop circuit of the present invention; and FIG. 9 is a detail view of the pick-up head limit switch.

DESCRIPTION OF THE PREFERRED EMBODIMENT

Figure 1:
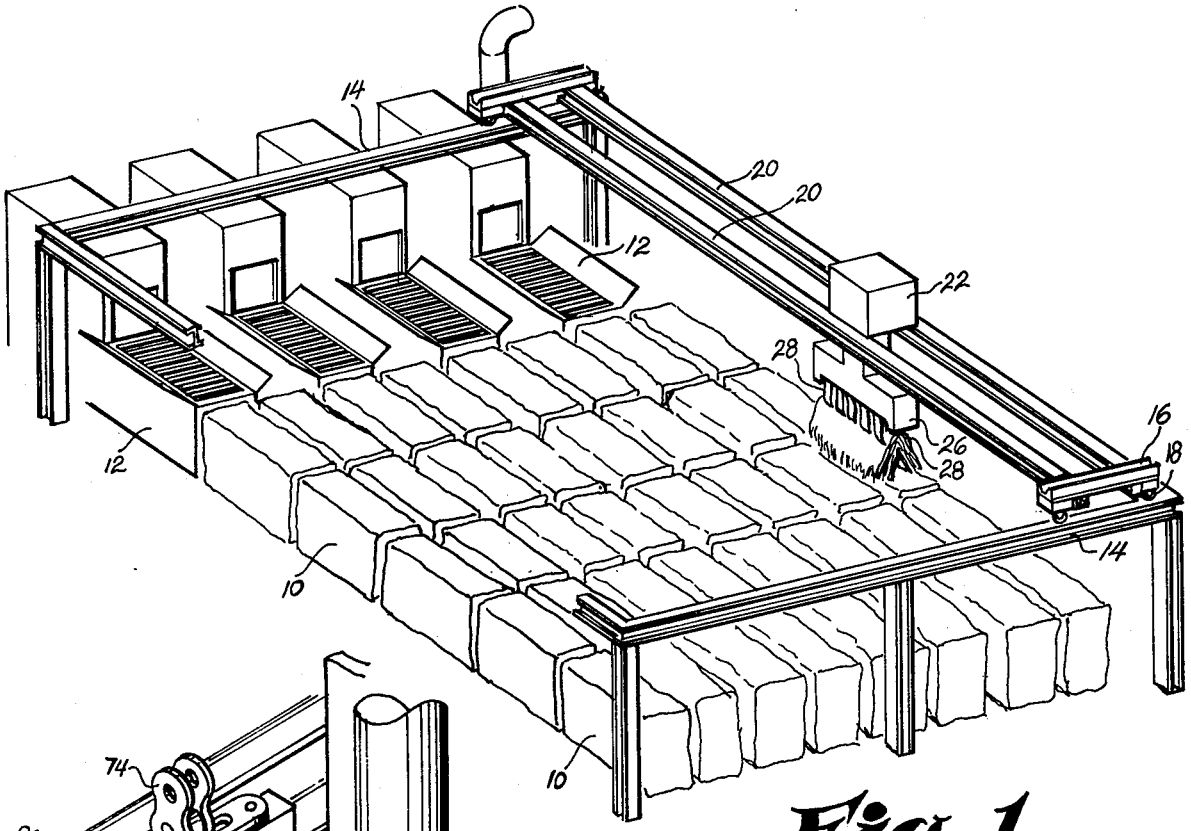
FIG. 1 is a perspective view of a fiber pick-up and transporting apparatus which includes the safety switches of the present invention.

Looking now in greater detail at the accompanying drawings, FIG. 1 illustrates a bale laydown including a plurality of bales 10 arranged in parallel lines extending behind a plurality of hoppers 12, and apparatus for automatically plucking fibers from the bales 10 in a predetermined sequence and delivering such fibers to the hoppers 12, this automatic apparatus being of the same general type as that described in greater detail in the aforementioned Keller U.S. Pat. No. 3,777,908, issued Dec. 11, 1973.

This automatic plucking and feeding apparatus includes an elevated trackway 14 on which is mounted a crane 15 having wheels 18 that permits the crane 16 to be rolled along the trackway 14 and above the bales 10. The crane 16 includes parallel tracks 20 extending generally parallel to the lines of bales 10, and a dolly 22 is mounted on the tracks 20 by wheels 24 (see FIG. 2) for movement therealong. The dolly 22 supports a pick-up head 26 arranged for vertical movement with respect to the dolly 22, and the pick-up head 26 includes a plurality of cooperating finger elements 28 that open and close to pluck fibers from the bales 10 when the pick-up head 26 is lowered to a predetermined position with respect thereto.

The crane 16, dolly 22, pick-up head 26 and finger elements 28 are each powered by a separate electric motor (not shown), and the movement of these respective components is controlled in a predetermined sequence by an electrical control circuit, the details of which form no part of the present invention. For purposes of the present invention, it is sufficient to understand that the crane 16 is provided with a plurality of pivoted switches 30 depending vertically as best seen in FIG. 5 so as to be tripped when they engage raised cam members 32 situated on the trackway 14, and the dolly 22 is likewise provided with similar switches 34 for engaging raised cam members 34 situated on the crane tracks 20. One trackway cam 32 is located to correspond with each line of bales 10, and one crane track cam 36 is located to correspond with each bale 10 in a given line of bales in the bale laydown. The aforementioned control circuit can then operate the apparatus to locate, in a predetermined sequence, the pick-up head 26 above any bale 10 in the bale laydown by moving the crane 16 to any predetermined line of bales 10 and by moving the dolly 22 to a position above any particular bale 10 in the line of bales, after which the pick-up head 26 is automatically lowered until a sensor element 38 (FIG. 2) strikes the particular bale 10 to cause the finger elements 28 to automatically close and thereby pluck a predetermined quantity of fiber from such bale, as described in greater detail in the aforementioned U.S. Pat. No. 3,777,908. The pick-up head 26 is then automatically raised, and the dolly 22 and crane 16 are moved to position the pick-up head 26 above a predetermined hopper 12 where the finger elements 28 are opened to release the plucked fibers and drop them into such hopper 12.

While the above describes the normal operation of the apparatus, it has been found that occasionally the apparatus will operate abnormally in several particulars, and this abnormal operation can create a dangerous situation, not only in terms of seriously damaging the apparatus itself but also in terms of injuring personnel who may be working in the vicinity of the apparatus while it is operating. In accordance with the present invention, a number of coordinated safety switches and controls are added to the apparatus to prevent, or at least significantly lessen, the danger associated with particular possible abnormal operations of the apparatus. Basically, this safety circuit arrangement of the present invention includes a plurality of switches each designed to be actuated by a specific malfunction of the apparatus. All but two of these switches are included in a safety circuit which, upon the actuation of any one of such switches will stop further operation of the apparatus and sound an alarm that indicates the occurence of a malfunction. This safety circuit is illustrated in FIG. 8, and will be described in greater detail hereinafter below. Two other switches are provided to carry out specific action of the apparatus, one of such switches also being included in the alarm circuit.

In the normal operation of the crane 16, it moves back and forth along the trackway 14 in response to the control panel and the action of switches 30 and the trackway cams 32, and this movement is well within the lengthwise limits of the trackway 14. However, it is possible, because of the improper operation of the switches 30 or other malfunction, for the crane 16 to inadvertently be driven by its motor past the last cam at each end of the trackway 14 (which should reverse the direction of movement of the crane 16), and it will be apparent that this inadvertent movement of the crane 16 could cause it to be driven off the end of the trackway 14 which could cause serious damage or injury. According to the present invention, the crane 16 is provided with a safety cam 40 located adjacent each transverse end thereof, one such cam 40 being clearly shown in FIG. 5, and the trackway 14 is provided with a safety switch 42 located adjacent each transverse end thereof as shown in FIGS. 4 and 5. The safety switches 42 are positioned so that they will be engaged by the safety cams 40, and thereby actuated, only when the crane 16 has moved past predetermined points at each transverse end of the trackway 14, such predetermined points being points beyond the normal limits of movement of the crane 16 as described above. Additionally, the transverse end of the trackway 14 may be provided with bumpers 44 which serve to stop movement of the crane 16 if it should inadvertently coast past the point at which a cam 40 actuates a safety switch 42.

Similarly, the dolly 22 is provided with a safety switch 46 depending therefrom in staggered relation to the aforementioned pivoted operating switches 34 used in the normal operation of the dolly 22, and one of the crane tracks 20 is provided with a safety cam 48 located adjacent each end thereof as best seen in FIGS. 4 and 6. The location of the safety cams 48, and the position of the safety switch 46 is such that if the dolly 22 should inadvertently move past predetermined points located beyond the normal limits of movement of the dolly 22 on the crane tracks 20, the safety switch 46 will be actuated by engagement with the safety cam 40. Also, one of the crane tracks 20 is provided at each end thereof with bumpers 50 similar in form and function to that of crane bumpers 44 described above.

Figure 7:
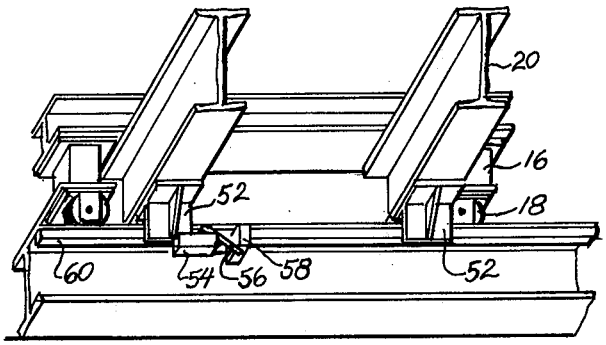
FIG. 7 is a detail view of the safety switch that is actuated by the crane assuming a predetermined canted relationship to the trackway.

Another malfunction which could cause serious damage would be for the crane 16 to become derailed, or to assume a canted relationship with the trackway 14 on which it moves, particularly if the crane motor continues to drive the crane 16 after it has assumed such canted relationship. Accordingly, the tracks 20 of the crane 16 each have a flange member 52 depending therefrom (see FIG. 7) so as to normally be positioned in spaced relation to the trackway 14 on which the crane wheels 18 roll, and one of these flange members 52 has mounted thereon a safety switch 54 which includes an extending switch lever arm 56 that supports at the end thereof a bifurcated element 58. The spaced arms of the bifurcated element 58 extend upwardly in spaced relation along each side of a projecting shoulder element 60 extending along the transverse length of the portion of the trackway 14 on which the crane wheels 18 roll. As long as the crane 16 maintains its normal relationship with the trackway 14, that is with the crane wheels 18 aligned with the trackway part on which they roll and with the crane tracks 20 extending perpendicularly with respect to such trackway part, the bifurcated element 58 will simply move along the fixed shoulder element 60 in spaced relation thereto. If, however, the crane 16 should inadvertently assume a predetermined canted or cocked relationship with the trackway 14, and thereby create a potential derailing situation for the crane 16, the bifurcated element 58 will engage the shoulder element 60 and cause movement of the lever arm 56 so as to actuate the derailing safety switch 54. If the crane 16 should be canted to a somewhat greater extent after the derailing safety switch is actuated, the depending flanges 52 will engage the trackway 14 and resist the tendency of the crane 16 to become completely derailed.

Figure 3:
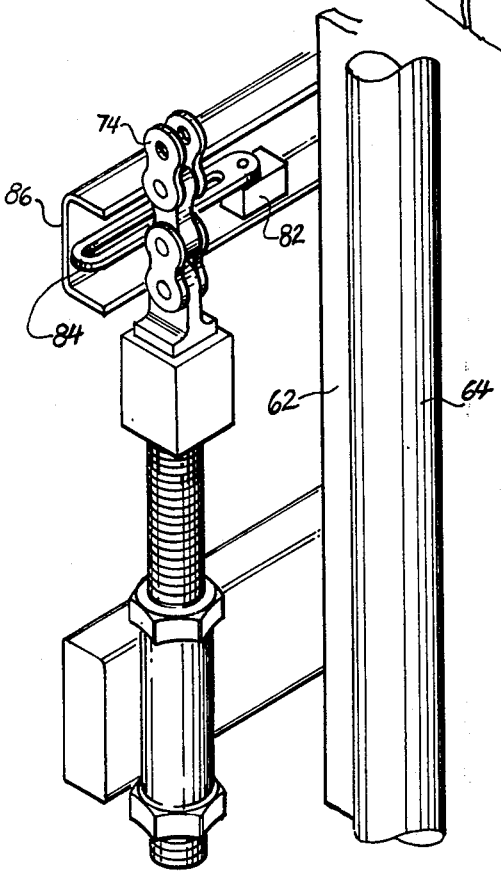
FIG. 3 is a detail view taken at the right side of the pick-up head illustrated in FIG. 2 and showing the pick-up head at a lowered position.
Figure 2:
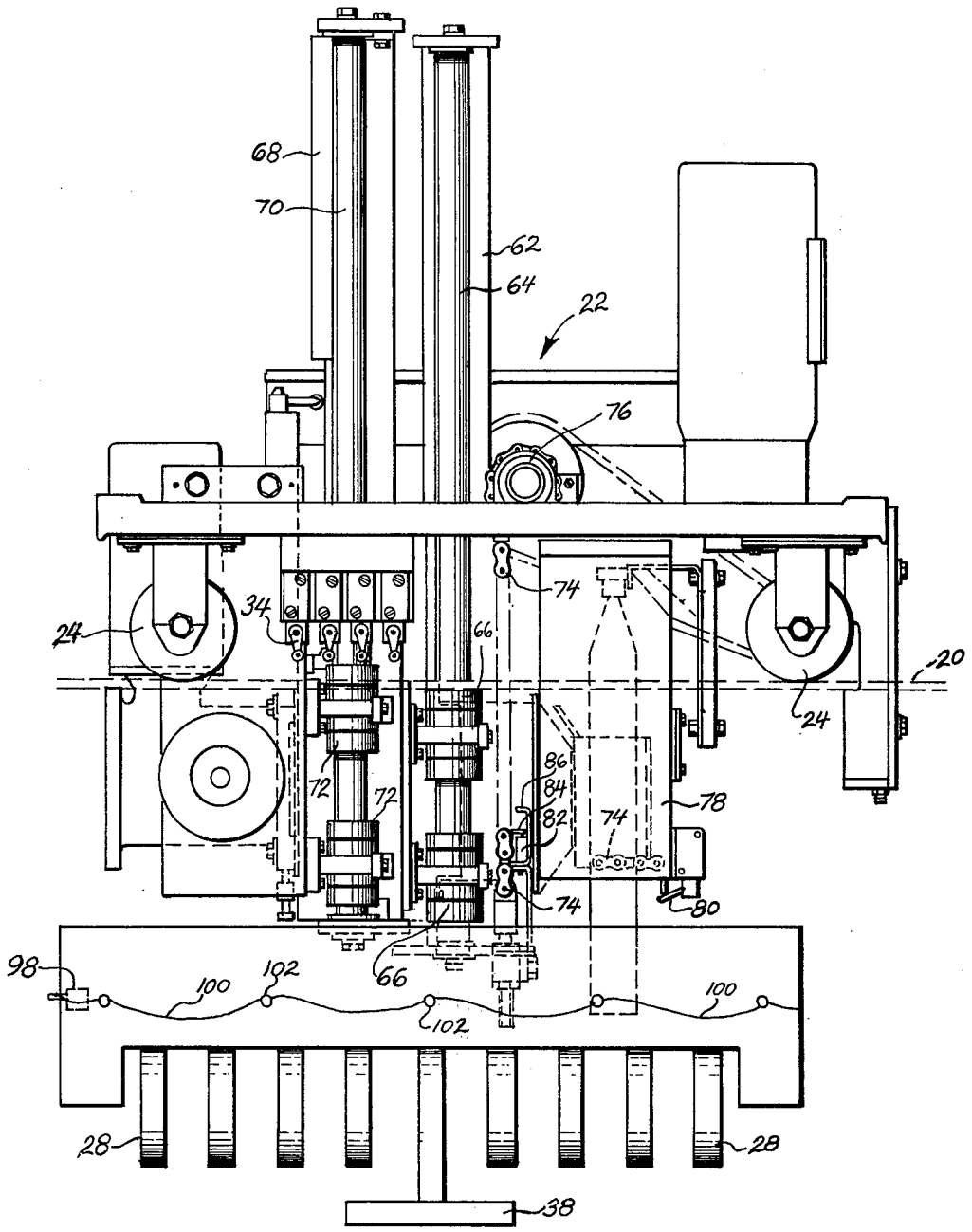
FIG. 2 is a left side elevational view of the pick-up head of the apparatus illustrated in FIG. 1.

As best seen in FIG. 2, the dolly 22 supports the pick-up head 26 for vertical movement with respect thereto, the pick-up head 26 being fixed to a first post member 62 that includes a pair of spaced, parallel tubular elements 64 (one being seen in FIG. 2 and the other in FIG. 3) slidably mounted in bearings 66 that are fixed to a second post member 68 also provided with a pair of parallel tubular elements 70 slidably mounted in bearings 72 fixed to the undercarriage of the dolly 22. The lower end of the first post member 62, at which the pick-up head 26 is attached, is secured to one end of an extendable line, preferably a link chain 74 that extends upwardly and around a motor-operated sprocket 76 and into a chain storage magazine 78 where the other end link of the chain 74 is attached to a safety stop switch 80 mounted at the bottom of the chain storage magazine 78 and extending thereinto.

During normal operation, when the motor-operated sprocket 76 is rotated in a counterclockwise direction as seen in FIG. 2, the chain 74 is fed from the storage magazine 78 and extended whereby both the first and second post members 62, 68 move downwardly together by the force of gravity with the tubular elements 70 sliding in the fixed bearings 72 until the upper end of the second post member 68 reaches the uppermost fixed bearing 72 whereupon further vertical movement of the second post member 68 is stopped. If, however, the chain 74 continues to be extended, the first post member 62 will continue to be lowered with the tubular elements 64 thereof sliding in the bearings 72.

The downward movement of the pick-up head 26 will continue until the sensor element 38 strikes a bale 10, whereby the cooperating finger elements 28 will be closed by a separate motor (not shown) located within the pick-up head 26 and the control circuit will automatically reverse the direction of rotation of the sprocket 76 to retract the chain 74 and raise the first and second post members 62, 68 and the pick-up head 26 to their uppermost position as shown in FIG. 2.

Occasionally, however, the pick-up head 26 will be lowered to a position at which the sensor element 38 strikes a bale, but the sensor element 38 will not function properly to cause the control circuit to stop further downward movement of the pick-up head 26. In accordance with the present invention, a back-up arrangement is provided for the sensor element 38, such back-up arrangement being in the form of a switch 82 (see FIG. 3) mounted on the second post member 68 and having a lever 84 biased in a direction to urge the lever 84 against the chain 74. The sensor element 38 normally strikes a bale 10 and causes the control circuit to raise the pick-up head 26, as aforesaid, before the pick-up head 26 actually comes into contact with the bale 10, and therefore, during normal operations, the chain 74 is always taut under the weight of the pick-up head 26. If, however, the sensor element 38 fails to operate, the motor-operated sprocket 76 will continue to pay out the chain 74, whereupon the pick-up head 26 and cooperating fingers will actually come to rest atop the bale 10 and a slack will form in the chain 74 as it continues to be paid out. A guide bracket 86 is provided adjacent the switch lever 84 and on the opposite side thereof with respect to the chain 74 to assure that when slack forms in the chain 74, the chain 74 will fall away from the switch lever 84, whereby the bias acting against the lever 84 will cause it to move with the chain 74 in a direction away from the bracket 86. The switch 82 is designed so that it will not be actuated so long as the chain 74 is taut, but it will become actuated by the aforesaid movement of the lever 84 away from the bracket 86 when a predetermined slack forms in the chain 74. When the switch 82 is operated, it will perform the identical function as the sensor element 38 to cause the finger elements 28 to close and the pick-up head 26 to be raised to its uppermost vertical position.

As a further back-up for the sensor element 38 the first post member 62 has mounted thereon a limit switch 88 having a pivoted lever 90 with a roller 92 at the end thereof (see FIG. 9), and the second post member 68 is provided with a plate element 94 mounted thereon to present a shoulder 96 located in the path of the roller 92 during downward movement of the first post member 62 relative to the second post member 68. The plate element 94 is particularly located so that the shoulder 96 will only engage the roller 92 when the combined vertical extension of the first and second post members 62, 68 is such that the finger elements 28, when closed, are located somewhat above the floor level on which the apparatus is supported and the limit switch 88 is arranged in the control circuit to perform, when actuated, the identical function as the sensor element 38 and to also close the alarm circuit shown in FIG. 8. Thus, when a bale 10 is inadvertently allowed to become almost completely exhausted without being replaced, and the sensor element 38 is not sufficiently engaged by such exhausted bale so as to cause the control circuit to close the finger elements 28 and raise the pick-up head 26, the limit switch 88 will act in the place of the sensor element 38 to cause such actions when the roller 92 engages the shoulder 96, and the limit switch 88 will additionally sound an alarm whereby the operator of the apparatus can observe the exhausted bale supply and have it corrected while the apparatus otherwise continues to operate in its normal sequence.

As previously discussed, a safety stop switch 80 is mounted on the chain magazine 78 and is connected to the end link of the chain 74. The chain 74 has a predetermined length which is selected so that when it is fully extended, the pick-up head 26 and the finger elements 28 will be located slightly above the floor surface on which the apparatus is positioned, which is an abnormally low position for the pick-up head 26 indicating that it is not functioning properly. Thus, if the pick-up head 26 reaches this abnormally low position, the chain 74 would be fully extended and the end link thereof attached to the safety stop switch 80 would actuate such switch to thereby stop the apparatus and sound an alarm. It is to be noted that this abnormally low position of the pick-up head 26 is designed to be lower than the position of the pick-up head 26 at which the previously described limit switch 88 is actuated, whereby the limit switch 88 should act to cause the pick-up head 26 to be raised before it reaches the position at which chain 74 is fully extended to actuate safety stop switch 80. To this extent, the safety stop switch 80 acts as a back-up safety factor for the limit switch 88. Additionally, the safety stop switch 80 also acts as a back-up for the chain slack indicating switch 82. For example, if the pick-up head 26 actually came to rest on a bale 10 in a manner to normally cause actuation of the chain slack switch 82 as described above (e.g. due to a malfunction of the sensor element 38), and the chain slack switch 82 is for some reason not actuated, the chain 74 will continue to be paid out until the safety stop switch 80 is actuated. Thus, there are three safeguards, in addition to the sensor element 38, which act to prevent an improper or inadvertent lowering of the pick-up head 26, namely the chain slack switch 82, the limit switch 88, and the safety stop switch 80. It is to be emphasized that the lowering of the pick-up head 26 directly into an area where working personnel are located creates a situation which can be potentially dangerous to such personnel and the present invention provides a substantially foolproof warning and safety system designed to automatically protect personnel as well as the equipment itself.

In addition to the automatic switches described above, the present invention also includes a manually operable safety switch that can be actuated at any time by personnel near the pick-up head 26 who observe a potentially dangerous situation developing. As best seen in FIG. 2, the pick-up head 26 includes an emergency switch 98 extending out of one end thereof, and this emergency switch 98 is connected to a pull-cord 100 that is strung around the entire periphery of the pick-up head 26 through a plurality of eyelets 102. If, at any time, the pull-cord 100 is manually pulled, it will immediately actuate the emergency switch 98 which will stop the operation of the apparatus, sound an alarm, and cause the finger elements 28 to be opened if they are closed at the time the emergency switch is actuated. Thus, if personnel standing anywhere near the pick-up head 26 see a dangerous situation, it is a relatively simple matter to reach over and pull the pull-cord 100 to actuate the emergency switch 98. Moreover, even if a worker should somehow become trapped beneath the pick-up head 26 and the finger elements 28 should close on such worker, he could reach up around the side of the pick-up head 26 and pull the pull-cord 100, whereupon he would immediately be released by the opening of the finger elements 28, and the apparatus would stop.

FIG. 8 is a block diagram illustrating diagrammatically the electrical alarm and safety circuit of the present invention, and it includes all of the previously described safety switches, and an alarm 104, which may be a horn, bell or the like. A block 106, identified as "Motor Power," represents all of the electrical motors which drive the crane 16, the dolly 22, the pick-up head 26, and the finger elements 28, and a block 108, identified as "Finger OPEN Control," represents the motor control which opens the cooperating finger elements 28. The crane derail switch 54, the chain magazine switch 80, the dolly limit switch 46, the crane limit switch 42, and the emergency pull-cord switch 98 are all normally closed switches which are opened when actuated as described in detail above, and the pick-up head limit switch 88 is normally open and is closed upon actuation thereof.

Under normal operating conditions, the alarm and safety circuit would be as shown in FIG. 8 with the motor power 106 being energized through the normally open contact A″ of a solenoid operated relay A, the alarm 104 de-energized because of the normally closed contact A′ of the relay A and the normally open contact C′ of de-energized solenoid operated relay C, and the finger-open control 108 is de-energized because of normally closed contact B′ of solenoid operated relay B.

If, however, any one of the switches 42, 46, 54, 80 or 98 are opened, because of actuation thereof, the relay A is operated to close normally open contact A″, which immediately de-energizes the motor power 106 to the apparatus, and to open its contact A′, whereupon the alarm 104 is energized.

It is to be noted also that whenever the emergency pull-cord switch 98 is opened by actuation thereof, relay B will be de-energized to open contact B′ to thereby energize the finger-open control motor 108, in addition to de-energizing the motor power 106 and energizing the alarm 104. Preferably, a finger limit switch 112 is included in the circuit with contact B′ and finger open control 108, this switch 112 being a mechanical switch that is normally closed as shown and that is mechanically opened when the finger elements 28 reach an open position to thereby stop further power being supplied to finger open control 108 after the finger elements are opened.

Finally, if the pick-up head limit switch 88 is closed by actuation thereof, solenoid C will be energized to close its normally open contact C′ and thereby energize the alarm 104 and also energize, through a second normally open contact C″ of the solenoid C, a light 110 which indicates that the bale supply is low at the bale station where the pick-up head limit switch 88 was caused to be actuated. It is to be noted that actuation of the pick-up head limit switch 88 has no effect on the circuit of the motor power 106.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. In combination with apparatus for automatically picking up fibers from a plurality of bales and delivering said fibers to a collecting point, said apparatus including track means, crane means mounted on said tracks for movement therealong in response to receipt of an electrical signal, dolly means mounted on said crane for movement with respect thereto, and pick-up head means mounted on said dolly means for vertical movement with respect thereto by an extendable line means fed from said dolly means, the improvement comprising:

a. alarm means;

b. an electrical circuit for said alarm means including a plurality of electrical switch means each being selectively actuated to energize said alarm in response to a predetermined condition of said apparatus, said switch means including:

i. a first switch connected to a pull cord mounted on said pick-up head and closeable upon the pulling of said pull-cord;

ii. a second switch associated with said extendable line and closeable in response to the entire length of said extendable line being fed from said dolly means;

iii. a third switch associated with said pick-up head means and closeable in response to said pick-up head being moved a predetermined vertical distance beneath said dolly means;

iv. a fourth switch associated with said dolly means and closeable in response to said dolly means moving past a predetermined point on said crane means;

v. a fifth switch associated with said crane means and closeable in response to said crane means moving past a predetermined point on said track means; and vi. a sixth switch associated with said crane means and closeable in response to said crane means assuming a predetermined canted relationship with respect to said track means.

2. In combination with the apparatus defined in claim 1 and including electric motor means for causing said movement of said crane means, said dolly means and said pick-up head means, the improvement being further characterized in that a second electric circuit is provided for automatically de-energizing said electric motor means, said second electric circuit including said first, second, fourth, fifth and sixth switches and being operable to de-energize said electric motor means in response to said actuation of any one of said switches.

3. In combination with apparatus for automatically picking up fibers from bales and delivering said fibers to a collecting point, said apparatus including support means on which is mounted a pick-up head means having a first control means including line means extending from said support means to said pick-up head means with said first control means being selectively operable to raise and lower said pick-up head means with respect to said support means by retracting and extending said line means, said pick-up head further including cooperating fiber engaging finger elements and a second control means for selectively opening and closing said cooperating finger elements, the improvement comprising a slack indicating switch means associated with said extendable line means and operable in response to a predetermined slack forming in said extendable line means to cause said second control means to close said finger elements and to cause said first control means to raise said pick-up head to its uppermost position.

4. In combination with the apparatus defined in claim 3, the improvement being further characterized in that said slack indicating switch means includes a pivoted lever biased in a direction to urge said lever against said extendable line means, said lever being moveable by said bias from an inoperative position when said extendable line is taut to an operative position when a predetermined amount of slack forms in said extendable line means.

5. In combination with the apparatus defined in claim 4, the improvement being further characterized in that guide means is provided adjacent said lever on the opposite side thereof with relation to said extendable line means to prevent movement of said lever and said extendable means in a direction opposite to said direction in which said lever is urged by said bias when slack forms in said extendable line means.

6. In combination with the apparatus defined in claim 3 and including sensor means associated with said pick-up head means and arranged to strike and fiber bales during downward movement of said pick-up head means, said sensor means including a sensor switch operable upon said sensor means striking one of said fiber bales to cause said second control means to close said finger elements and to cause said first control means to raise said pick-up head means to its uppermost position, the improvement being further characterized in that limit switch means is associated with said pick-up head means and is operable in response to said pick-up head means being lowered to a predetermined position beneath said support to cause said second control means to close said finger elements and to cause said first control means to raise said pick-up head means to its uppermost position.

7. In combination with the apparatus defined in claim 3, the improvement comprising manually operated switch actuating means extending around the periphery of said pick-up head and an emergency switch means operated by said switch actuating means, said emergency switch means being operable to de-energize said first control means to thereby stop further operation of said apparatus and to cause said second control means to open said finger elements when said finger elements are closed at the time said emergency switch is operated.

8. In combination with the apparatus defined in claim 7, the improvement being further characterized in that said switch actuating means includes a pull-cord strung around the periphery of said pick-up head means and connected to said emergency switch for operating the same when said pull-cord is pulled.

9. In combination with the apparatus defined in claim 3, the improvement being further characterized in that said extendable line means has a predetermined length with one end thereof being connected to said pick-up head means and being paid out and retracted from a supply area by said first control means, and in that the other end of said extendable line means is connected to a stop switch operable in response to the entire length of said extendable line means being paid out to de-energize said first control means and stop further movement of said pick-up head means.

10. In combination with apparatus for automatically picking up fibers from bales and delivering said fibers to a collecting point, said apparatus including support means on which is mounted pick-up head means having a first control means including a line of predetermined length extending from said support means to said pick-up head means with said first control means being selectively operable to raise and lower said pick-up head means with respect to said support means by paying out and retracting one end of said line means, said pick-up head further including cooperating fiber engaging finger elements and a second control means for selectively opening and closing said cooperating finger elements, the improvement comprising:

a. slack indicating switch means associated with said extendable line means and operable in response to a predetermined slack forming in said extendable line means to cause said second control means to close said finger elements and to cause said first control means to raise said pick-up head to its uppermost position;

b. limit switch means associated with said pick-up head means and operable in response to said pick-up head means being lowered to a predetermined position beneath said support to cause said second control means to close said finger elements and to cause said first control means to raise said pick-up head to its uppermost position;

c. manually operated switch actuating means extending around the periphery of said pick-up head means and connected to emergency switch means, said emergency switch means being operable in response to the manual actuation of said actuating means to de-energize said first control means and thereby stop further movement of said pick-up head means and to cause said second control means to open said finger elements when said finger elements are closed at the time said emergency switch is operated; and d. stop switch means connected to the other end of said extendable line means and operable in response to the entire length of said extendable line means being paid out to de-energize said first control means and stop further movement of said pick-up head means.

11. In combination with the apparatus defined in claim 10, the improvement being further characterized in that electrically operated alarm means is provided which includes an electrical energizing circuit means therefor that is normally open, and in that said alarm energizing circuit is closed to energize said alarm by the operation of any of said limit switch means, said emergency switch means, or said stop switch means.

* * * * *